United States Patent [19]

Wincze et al.

[11] Patent Number: 4,510,892

[45] Date of Patent: Apr. 16, 1985

[54] SEAL FOR BOILER WATER WALL

[75] Inventors: Steven P. Wincze, Windsor; Earl K. Rickard, East Granby, both of Conn.

[73] Assignee: Combustion Engineering, Inc., Windsor, Conn.

[21] Appl. No.: 621,973

[22] Filed: Jun. 18, 1984

[51] Int. Cl.[3] ..... F22B 37/24

[52] U.S. Cl. ..... 122/510; 122/4 D; 122/6 A; 165/81; 165/82

[58] Field of Search ..... 122/6 A, 4 D, 224, 510, 122/209 R; 110/171; 165/81, 82, 83

[56] References Cited

U.S. PATENT DOCUMENTS 2,870,750 1/1959 Langvand ..... 122/6 A 3,814,174 6/1974 Beggs ..... 165/82

4,387,651 6/1983 Moore ..... 110/171

*Primary Examiner*—Edward G. Favors

*Attorney, Agent, or Firm*—Robert L. Olson

[57] ABSTRACT

A boiler (10) made up of three separate sections consisting of (1) a bottom supported fluidized bed (12); (2) a top supported upper furnace portion (14); and (3) a vertical boiler section (24) in fluid communication with the furnace outlet. Seals (34, 36) are located between each of the three sections, so they can expand thermally relative to each other while preventing the surrounding atmosphere from exposure to the hot combustion gases. The seals consist of fluid cooled (48, 70) troughs (38, 60) containing sand (40, 62), with fluid cooled (48, 70) plates (42, 64) extending down into the sand.

5 Claims, 3 Drawing Figures

SEAL FOR BOILER WATER WALL

BACKGROUND OF THE INVENTION

One present day means of burning coal in an environmentally acceptable manner is in a fluidized bed. Although this is a viable arrangement from an environmental point of view, it does present other problems to be overcome. One of these problems is the manner in which the fluidized bed and its associated boiler are to be supported. This problem is made more complex when the fuel feed for the fluidized bed furnace is from the top of the unit, since most large boilers are top supported, in order to allow for thermal growth of the unit.

SUMMARY OF THE INVENTION

In accordance with the invention, a water wall boiler and its associated fluidized bed furnace is provided, having the coal being fed to the unit from the top. The fluidized bed is bottom supported, while the two sections of the water wall thereabove are each independently top supported. A fluid cooled granular seal arrangement is provided between the bed and the water wall thereabove, and also between the two sections of water wall, so as to provide for unequal thermal growth between these three separate sections.

DESCRIPTION OF THE PREFERRED EMBODIMENT

Figure 1:
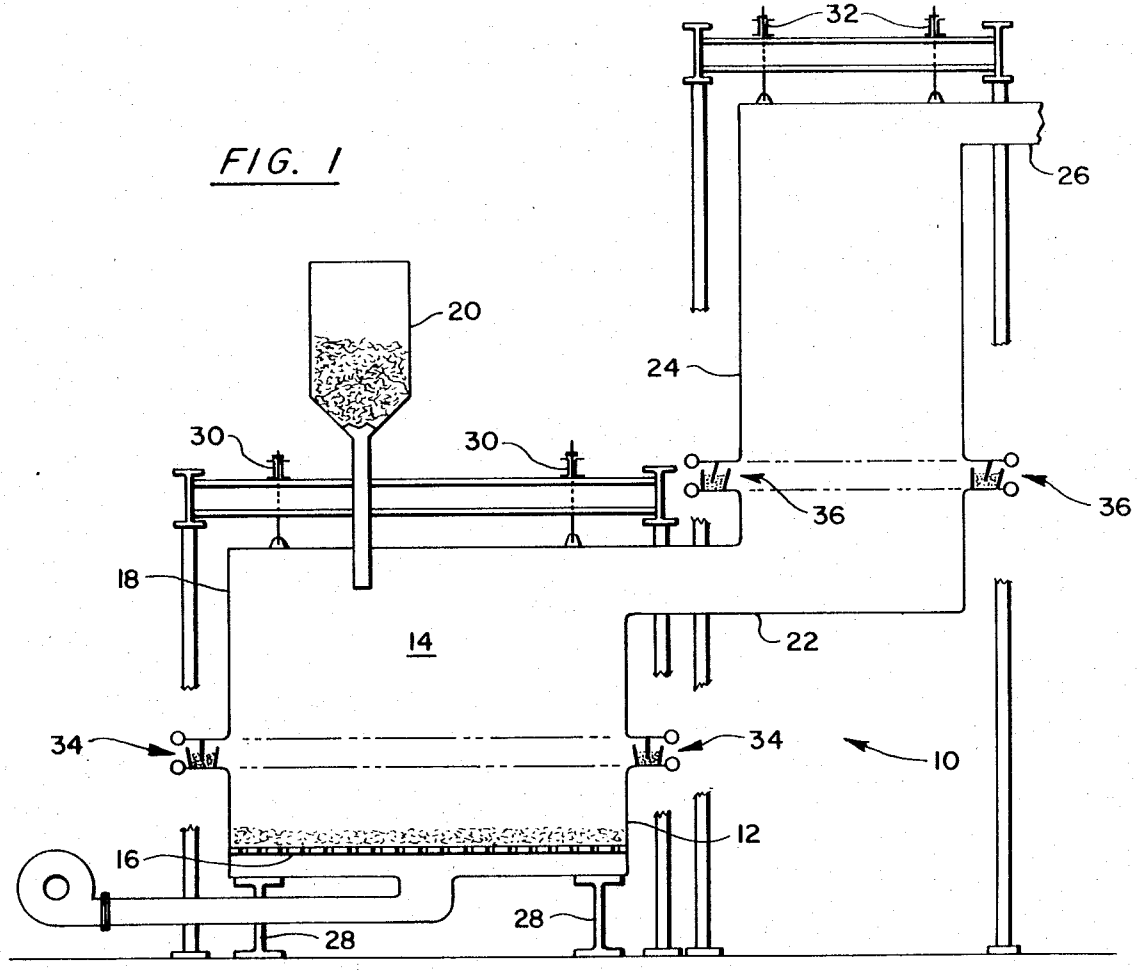
FIG. 1 is a schematic of a water wall boiler having a coal-fired, fluidized bed incorporating the fluid cooled granular seal arrangements of the invention.

Looking now to FIG. 1, numeral 10 designates a water wall boiler having a coal-fired, fluidized bed 12 in the lower portion of a furnace 14. Air is supplied from beneath a perforated grate 16 to both fluidize the inert material and coal, and to also support the combustion of the coal. The walls of the furnace are lined with steam generating or other fluid cooled tubes, as are the walls of all of the boiler sections thereabove.

Coal is introduced to the furnace through the roof 18 from hopper 20. The combustion gases, after passing through the furnace 14, horizontal pass 22, and vertical pass 24, exit from the unit through duct 26. In addition to the tubes lining the walls of the boiler, other steam generating or heating surface (not shown) is located within the various gas passes.

During startup of the unit, the various walls of the unit have different thermal growth, depending on the length of the tubes making up the surface, and the temperature they are subjected to. For this reason, various parts of the unit are separately and independently supported. The bed portion 12 of the furnace is bottom supported by pedestals 28, while the upper portion of the furnace is top supported from beams 30. The remaining vertical portion 24 of the unit is independently top supported by beams 32. Since the unit does not operate at atmospheric pressure, but rather is at a pressure slightly above or below, it is necessary to provide seals between these three boiler sections which will allow differential thermal growth or movement therebetween. Seal 34 allows this movement between the lower and upper furnace sections, while seal 36 permits relative movement between the upper furnace and the vertical boiler section 24.

Figure 2:
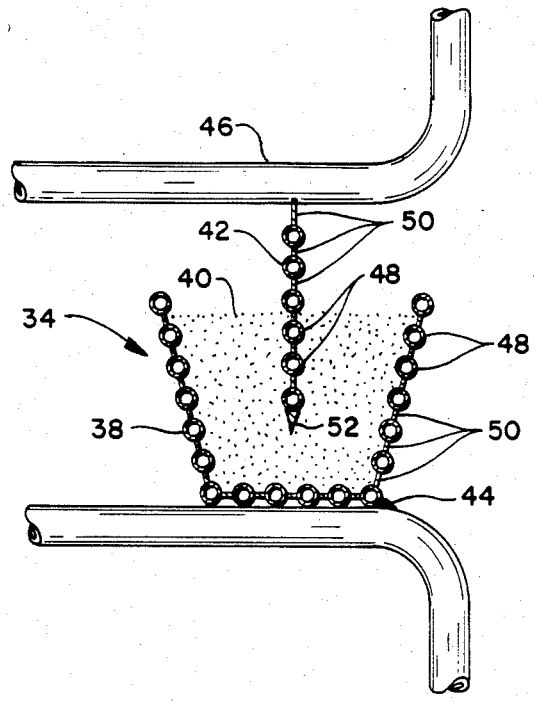
FIG. 2 is an enlarged sectional view of the lower seal shown in FIG. 1.

Looking now FIG. 2, the seal 34 is shown in more detail. The seal 34 consists of a trough 38, which is filled with a heat resistant granular material 40, and a plate 42 extending down into the granular material. The trough is seal welded at 44 to the tubes it is supported by. The plate 42 is attached to and supported by the tubes 46 thereabove, in a sealing manner. The trough 38 and plate 42 are endless; i.e., they extend around the entire periphery of the unit, so as to completely seal the opening between the top and bottom furnace portions. Water could be used as the sealing medium in the trough, but it has some drawbacks. At the furnace temperature of 1500°–1600° F., much steam would be generated, which would permeate throughout the boiler complex. Also, the large water loss would require a large amount of water to be continuously added to the seal. For this reason, sand is used as the sealing medium 40. There may be some loss of sand from the trough, which can be periodically checked by personnel and refilled, if necessary.

Both the trough 38 and the plate 42 are made up of tubes 48 with bars 50 welded therebetween, so that they do not become overheated. This surface can be fluid cooled in any manner, but most logically it will be steam generating surface incorporated into the boiler. The tubes making up the trough 38 could be fed by a header located outside the trough, and could discharge into a similarly located header (not shown). The tubes of the plate 42 could be supplied from and discharged to headers located above tubes 46. Some of the tubes 46 would have to be bent out of their normal plane to permit this, just as is commonly done to form burner and other openings in any welded wall furnace construction.

Since the relative movement between the upper and lower furnace portions is basically in a vertical direction, the plate 42 extends substantially in a vertical direction. In order to reduce the resistance of movement of the plate 42 into the sand, the lower edge 52 is pointed, to streamline the movement as much as possible. From the above, it can be seen that the lower furnace can grow upwardly with thermal expansion and the upper furnace can grow downwardly, with the only resistance to such movement being the friction of the plate 42 moving downwardly through sand 40.

Figure 3:
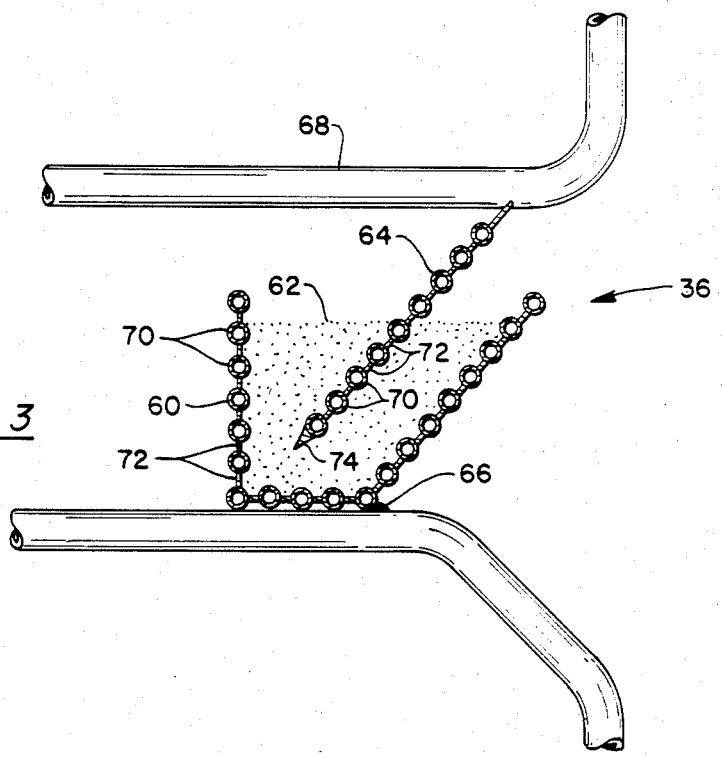
FIG. 3 is an enlarged sectional view of the upper seal shown in FIG. 1.

Looking now to FIG. 3, the upper seal 36 will be described in more detail. Like the lower seal 34, it consists of a trough 60 filled with sand 62, and a plate 64 extending down into the sand. The trough is seal welded at 66 to the tubes it is supported by. The plate 64 is attached to and supported by the tubes 68 thereabove, in a sealing manner. The trough and plate extend around the entire periphery of the unit, so as to completely seal the opening between the two separate boiler sections.

Again, the trough 60 and plate 64 are made up of tubes 70 with bars 72 welded therebetween. Again, this surface will generally be steam generating surface, although it could be any fluid cooled tubing. It can be incorporated into the circuit in the same manner as that described for the lower seal 34. The lower end of the plate 64 is pointed at 74 so that resistance to movement thereof through the sand is minimized.

Basically the upper seal 36 is identical to the lower seal 34 with one major exception. Because of the horizontal section 32 extending from the furnace 14, the relative movement between the boiler sections the seal 36 coacts with, the relative movement between these two portions is not in a perfectly vertical plane. There is a horizontal component to the relative growth or movement. Thus the plate 64 lies at an angle to the vertical, as can be seen in FIG. 3. The angle is calculated such that the plate 64 will move in the resultant plane of relative movement between the two sections, as these two sections are subjected to thermal growth. This will minimize the frictional resistance of movement of the plate through the sand.

We claim:

1. In combination, a boiler including a furnace having four enclosing sidewalls, a roof, and a perforated floor, means for introducing combustible material onto the perforated floor to be burned thereon, opening means in one of the sidewalls through which combustion gases can be exhausted from the furnace, first means for supporting a first section including the furnace floor and the lower portion of the sidewalls from the bottom, second means for supporting a second section including the upper portion of the sidewalls from the top, seal means located between the first and second sections for preventing the furnace interior from being exposed to the atmosphere when the two sections are subjected to thermal growth, said seal comprising a fluid cooling trough connected to the first section, the trough being filled with granular sealing material, and a fluid cooled plate connected to the second section and extending down into the granular sealing material, both the trough and the plate extending around the entire periphery of the furnace.

2. The combination set forth in claim 1, wherein the granular sealing material is sand.

3. The combination set forth in claim 1, including a third section of the boiler in fluid communication with the furnace opening means, third means for supporting the third section independently from the top, second seal means located between the second and third sections, for permitting thermal growth of the second and third sections, said second seal means comprising a fluid cooled second trough connected to the second section, the second trough being filled with granular sealing material, and a second fluid cooled plate connected to the third section and extending down into the granular sealing material, both the second trough and the second plate extending around the entire periphery of the second and third sections.

4. The combination set forth in claim 3, wherein the second plate lies in a plane which is at an angle to the vertical, which plane conforms to or is in alignment with the resultant direction of relative thermal movement between the second and third sections.

5. The combination set forth in claim 4, wherein the granular sealing material in both the first and second troughs is sand.

* * * * *